United States Patent [19]

Carson

[11] Patent Number: 4,803,931

[45] Date of Patent: Feb. 14, 1989

[54] FLUE RESTRICTOR

[76] Inventor: Brian Carson, 8621 Byron Road, North Delta, British Columbia, Canada, V4C 7P7

[21] Appl. No.: 849,665

[22] Filed: Apr. 9, 1986

[51] Int. Cl.[4] ..... F23L 13/04

[52] U.S. Cl. ..... 110/163; 126/285 A; 126/292; 137/625.31; 138/45; 138/46

[58] Field of Search ..... 110/163; 126/285 A, 126/292; 137/341, 625.3, 625.31; 138/42, 43, 44, 45, 46; 236/1 G

[56] References Cited

U.S. PATENT DOCUMENTS 292,349 1/1884 Payne ..... 137/625.31

607,669 7/1898 Underwood ..... 137/625.31 X 3,580,238 5/1971 Diehl ..... 110/163 X

*Primary Examiner*—Harold Joyce

*Attorney, Agent, or Firm*—Townsend & Townsend

[57] ABSTRACT

A flue restrictor to control air flow in a combustion apparatus having an exhaust system that includes a flue. The restrictor has a housing to be attached in the flue. There is a first valve member located in the housing and a second valve member located in the housing. Each valve member is composed of open and closed areas, and cooperates with the other valve member to act as a valve. Movement of one valve member relative to the other controls air flow in the restrictor, and thus in the combustion apparatus. The restrictor provides sensitive control and ease of adjustment in position.

1 Claim, 1 Drawing Sheet

FLUE RESTRICTOR

FIELD OF THE INVENTION

This invention relates to a flue restrictor for use on a combustion apparatus, usually a furnace, boiler or water heater.

DESCRIPTION OF THE PRIOR ART

The gas or oil burning furnace that finds wide application in central heating systems in the United States and Canada is a commendably efficient mechanical device. In the Northern United States and Canada such a furnace will typically be in daily use for six months of the year yet for the first ten or fifteen years of its life the only maintenance that is necessary is usually the occasional application of a small amount of lubricating oil and the annual changing of the filter.

From a combustion point of view the furnace is less commendable. When tested under laboratory conditions the typical efficiency is about 80% but field tests of a typical furnace boiler or water heater show that the actual working deficiency is closer to 50%. However even here the fault lies not with the furnace but with the exhaust or venting system through which the combusted gases pass to atmosphere.

It has been recognized for some time that this efficiency loss stems from the venting system allowing too much air to flow through the applicance.

When a combustion device is running the gases flow from a combustion chamber, through a heat exchanger, into the flue and then into the atmosphere. Air is fed to the combustion chamber for the combustion but the air fed is not in any way controlled in the usual combustion apparatus and this is the basis of the problem. Excess air lowers the temperature of the flue gases flowing through the heat exchanger. Furthermore the greater the draft of the flue then the more air is present to dilute that used by the burner and less heat reaches the heat exchanger.

The excess gas introduced is also undesirable in the actual combustion step. The excess air upsets the desirable ratios for combustion so that unburned fuel escapes into the flue.

Even when the combustion apparatus is not in operation air can still flow rapidly through the furnace causing a further loss of heat by taking heat from the apparatus as well as from the surroundings and exhausting that heat up the flue.

It is therefore clear that excess air flow through the combustion apparatus is undesirable. What is desirable is an optimum flow, able to support combustion at the maximum possible level and not so great that inefficient combustion and heat loss are induced.

Attempts at solving the above problems include those set out in Canadian Pat. Nos. 1,119,497 and 1,134,229.

Unfortunately these devices, although obviously helping to solve the problem, do so in a relatively unsatisfactory way. In particular although they are adjustable the adjustment means is relatively imprecise and the actual adjusting step laborious. Although they act to restrict the air flow through the combustion apparatus they do so in a way that cannot be fine tuned for an individual apparatus.

SUMMARY OF THE INVENTION

The present invention seeks to provide an apparatus in which fine tuning of the air flow through the combustion apparatus can be achieved.

Accordingly the present invention provides a flue restrictor to control air flow in a combustion apparatus having an exhaust system that includes a flue, the restrictor comprising a housing to be attached in the flue; a first valve member located in the housing and a second valve member located in the housing, each valve member being composed of open and closed areas, and cooperating with the other valve member to act as a valve whereby by movement of one valve member relative to the other, air flow in the restrictor, and thus in the combustion apparatus, is controlled.

DRAWINGS

Aspects of the invention are illustrated, merely by way of example, in the accompanying drawings in which.

DESCRIPTION OF THE PREFERRED EMBODIMENTS

Figure 1:
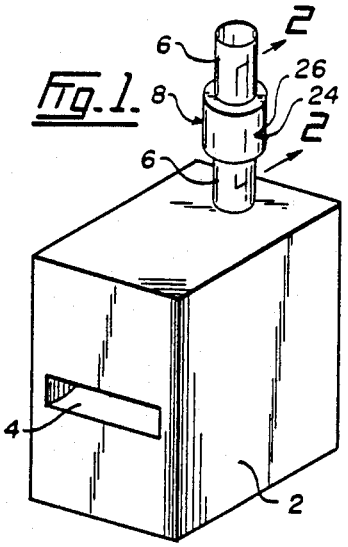
FIG. 1 is a general view of a furnace fitted with a flue restrictor according to the present invention.

In the drawings FIG. 1 shows a conventional furnace 2 having an air inlet 4. No details of the interior of the furnace are shown. They are entirely conventional. The furnace is fitted with a vent 6, typically a five, six or seven inch pipe. Only the first part of the vent, generally known as the flue, is shown in FIG. 1. Further although a furnace is shown the restrictor of the invention is useful with related devices such as water heaters and boilers.

In the flue 6 a restrictor 8 according to the present invention is attached.

Figure 2:
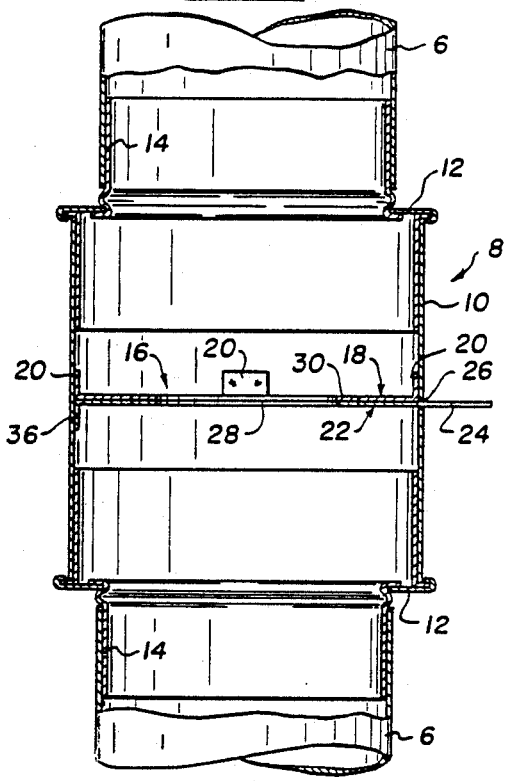
FIG. 2 is a section on the line 2—2 in FIG. 1.

As shown in more detail in FIG. 2 the restrictor 8 comprises a housing 10 attached in the flue 6. The housing 10 comprises end pieces 12 having projections 14 to engage flue 6. In accordance with conventional practice the upstream projection fits outside flue 6 and the downstream projection 14 fits within flue 6 to facilitate gas flow. The lower projection 14 is downstream of the upper projection 14, that is flow is upward.

There is a valve 16 associated with the housing 10.

Figure 3:
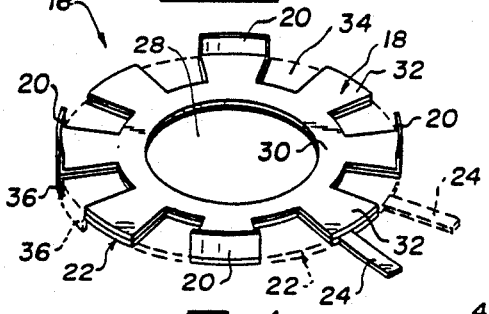
FIGS. 3 and 4 illustrate valve members useful in the restrictor of FIG. 2.

In the illustrated embodiment of FIG. 2 the valve comprises a first valve member 18 that is fixed within housing 10 by flaps 20 that are attached to housing 10 by spot welding. The valve is shown in FIG. 3. A second or lower valve member 22 is pivotable within the housing 10 and, as shown most clearly in FIG. 3, lever 24 extends outwardly from the valve member 22 to extend out from the housing 10. The lever 24 extends through slot 26 in the housing 10.

As shown particularly in FIG. 3 each valve member 18 and 22 comprises a plate. In the embodiment of FIG. 3 the plate has a central opening 28 formed within an inner ring 30. Discrete fins 32 extend outwardly from the inner ring 30 and there are spaces 34 between each fin 32. Generally speaking the area of a fin 32 is the same as the area of space 34. Second valve member 22 is generally the same as the first valve member 18 and differs only by having lever 24 and being without tabs 20 although a single tab 36 is desirable to assist in keeping the valve member 22 aligned in housing 10.

The arrangement of fins 32 and spaces 34 ensures that as the valve member 22 is rotated the valve moves from a fully open position, the solid line position shown in FIG. 3, to a fully closed position, the broken line position for the lower valve member 22 in FIG. 3.

Figure 4:
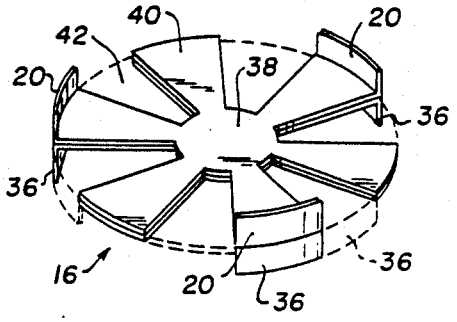

The embodiment of FIG. 4 differs from that of FIG. 3 by the provision of a central hub 38 for each valve member. Discrete fins 40 extend outwardly from the central hub 38 and there are spaces 42 between each fin 40. Again the fully open position is shown in solid lines in FIG. 4, the fully closed position is shown by the use of broken lines for the lower valve member in FIG. 4. The tabs 20 and 36 are as in the FIG. 3 valve member.

Figure 5:
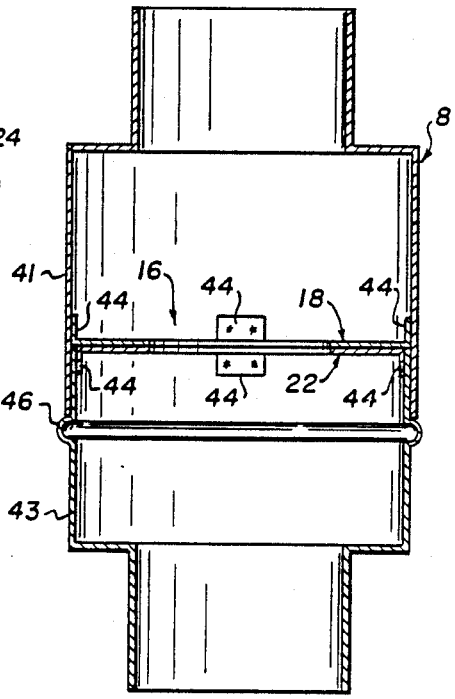
FIG. 5 illustrates a further embodiment of the invention.

It should be noted from both FIGS. 2 and 5 that the restrictor 8 is larger in cross section than the flue 8 that receive the restrictor. This is done to ensure that when the valve members are in the fully opened position the flow through the flue restrictor is the same as though the flue restrictor were not present.

The restrictor of the present invention is useful either in existing heating systems, or, may, of course, be installed when the heating system is installed. Installation is simple. The existing system is cut and part of the exhaust system removed, sufficient to enable the device according to the present invention to be inserted. The device may be screwed or riveted in position, using conventional techniques. Typically screws or rivets will be inserted at the overlapping parts of the system at the top and bottom of the restrictor.

Once the device is installed and valve member 22 is moved so that the flow through the restrictor is at its maximum, that is the valve is fully open. A draught reading is taken, using a conventional flow meter, below the restrictor 8. If the draught is excessive, as would be the case in a conventional system, then the valve member 22 is moved by pushing lever 24 to ensure at least partial overlap of the fins 32. This decreases the draught and thus the air supply. When optimum efficiency is reached the member 22 is locked in position by bending down the lever 24 and locating it, for example by riveting, to the exterior of the housing 10.

The optimum flow for highest efficiency for any one furnace can, of course, be determined from known figures. Such information is available in tables produced by various authorities.

It has been found desirable to arrange the area of the spaces 34 of the valve members 18 and 22 to ensure that flow through the restrictor can vary from 30% to 100% of the flow through an unrestricted exhaust system. Of course figures above 100% flow through the restrictor can be reached but there is no point in exceeding that figure. Figures below 30% are usually prohibited by local authorities as below that figure exhaust fumes can easily be forced back into the building.

The embodiment of FIG. 5 functions precisely as the embodiment of FIGS. 2 to 4. The embodiment of FIG. 5 differs from that of FIG. 2 in comprising an upper housing 41 and a lower housing 43 that are rotatable relative to each other. Each housing has located within it a valve member, for example as shown in FIGS. 3 and 4. However unlike the FIG. 2 embodiment, each valve member is located, within its respective housing, for example by the provision of flaps 44 that are riveted to the housing. There is a bead 46 provided on the lower housing 43 to control the depth of telescoping of the housings 41 and 43 and, in particular, to ensure the proper location of the valve members.

To use the device of FIG. 5 the restrictor is installed in a system as for the embodiment of FIG. 2 but the housings 41 and 43 are not located within the system. The housings are then rotated relative to each other to ensure that the most efficient flow is achieved, again by taking simple flow measurements using conventional, prior art equipment. Once the position is achieved the housings are each located within the exhaust system, for example by riveting.

The present invention reduces excess air flow through a furnace. Only the optimum amount of air for combustion is allowed to flow. Furthermore when the burners are switched off the flow is restricted and losses of heat due to draught are thus reduced. When the furnace is not combusting the heat loss is not as rapid because the air flow is not as rapid.

The illustrated devices may be made of the usual galvanized sheet metal common in gas fittings.

I claim:

1. A flue restrictor to control air flow in a combustion apparatus to burn oil or gas and having an exhaust system that includes a flue, the restrictor comprising:

a housing to be attached in the flue and comprising a first sub-housing and a second sub-housing having continuous, imperforate side walls;

a first valve member fixed at an end of the first sub-housing;

a second valve member fixed at an end of the second sub-housing, each valve member comprising a plate having a central opening within an inner ring with discrete fins extending outwardly from the inner ring and spaces between each fin;

the first and second sub-housings being positioned with the first and second valve members located against each other with the central openings of the valve members aligned, the valve members cooperating with each other to act as a valve, the sub-housings being rotatable relative to each other between a closed position of the valve where the fins of one valve member align with the spaces of the other valve member to an open position where the spaces of each valve member align;

means to lock the sub-housings in a predetermined relative position to control air flow in the restrictor and thus in the combustion apparatus;

the central openings in each valve member being so dimensioned that when the valve is closed the flow through the aligned central openings is about 30% of the flow through the unrestricted flue; and the sub-housings being enlarged relative to the flue so that when the valve is opened flow through the restrictor is the same as flow through the unrestricted flue.

* * * * *